US011988063B2

(12) United States Patent
Wiggins

(10) Patent No.: US 11,988,063 B2
(45) Date of Patent: May 21, 2024

(54) SPRING-LOADED SELF-ADJUSTING STUFFING BOX

(71) Applicant: Branden Wiggins, Aztec, NM (US)

(72) Inventor: Branden Wiggins, Aztec, NM (US)

( * ) Notice: Subject to any disclaimer, the term of this patent is extended or adjusted under 35 U.S.C. 154(b) by 256 days.

(21) Appl. No.: 17/484,879

(22) Filed: Sep. 24, 2021

(65) Prior Publication Data

US 2022/0098953 A1 Mar. 31, 2022

Related U.S. Application Data

(60) Provisional application No. 63/084,753, filed on Sep. 29, 2020.

(51) Int. Cl.
*E21B 33/08* (2006.01)
*E21B 17/042* (2006.01)

(52) U.S. Cl.
CPC ..... *E21B 33/08* (2013.01); *E21B 17/042* (2013.01)

(58) Field of Classification Search
CPC ..... E21B 33/08
See application file for complete search history.

(56) References Cited

U.S. PATENT DOCUMENTS 1,911,670 A * 5/1933 Black ..... E21B 33/08 277/504
1,930,982 A * 10/1933 Norris ..... E21B 33/08 277/525
6,394,461 B1 * 5/2002 Henderson ..... E21B 33/08 277/330
7,861,771 B2 * 1/2011 McCreedy ..... E21B 33/08 166/84.1
9,115,564 B1 * 8/2015 Villines ..... E21B 33/08

FOREIGN PATENT DOCUMENTS

CN 205805477 U * 12/2016
CN 105937380 B * 11/2018 ..... E21B 33/03
CN 110107245 A * 8/2019 ..... E21B 33/03
CN 209818010 U * 12/2019
CN 210483610 U * 5/2020
WO WO-2020113745 A1 * 6/2020

* cited by examiner

*Primary Examiner* — Matthew R Buck
(74) *Attorney, Agent, or Firm* — Schmeiser, Olsen & Watts LLP

(57) ABSTRACT

An improved wellhead stuffing box device is disclosed, having a coil spring, between a loading plate and the packing members of a stuffing box, and a housing threaded over the loading plate and the coil spring onto the outer wall of the stuffing box. The loading plate is adjacent the coil spring, which applies constant pressure on the packing members, causing the packing members to bulge continuously, as they wear out, thereby maintaining a seal between the packing members and a polish rod while in operation through the life of the packing members. The loading plate may be adjusted to adjust the spring force in the coil spring. The entire assembly has an aperture through its central longitudinal axis for the polish rod to oscillate there through. Embodiments include a stuffing box with an improved stuffing box cap.

9 Claims, 12 Drawing Sheets

SPRING-LOADED SELF-ADJUSTING STUFFING BOX

CROSS REFERENCE

The present non-provisional patent application claims priority to the Provisional patent application 63/084,753 titled Wellhead Stuffing Box Cap, filed on Sep. 29, 2020 by Branden Wiggins incorporated in its entirety herein and by cross reference.

BACKGROUND

On a well, such as an oil well, for example, being artificially lifted by means of a sucker rod pump, a polished rod operates through a stuffing box 10, as shown in FIG. 1, at a wellhead thereof, preventing escape of process water and/or crude oil and diverting it into a side outlet to which may be connected a flow line leading to an oil and gas separator or to a field storage tank. Between the polished rod (not shown) and the outer wall 14 of the stuffing box is packing material 16 that forms a seal between the polished rod and the outer wall. Two commonly-used types of packing are cone packing 18 and mound- or dome-style packing 20, as shown in FIGS. 2A and 2B, respectively. The packing may be typically one to five (commonly three or four) stacked annular members of a flexible material (commonly rubber, or the like) disposed between the polished rod and the outer wall 14 and resting on and supported by a rim or other supporting surface 22 of or engaging the bottom of the outer wall of the stuffing box. Generally, a threaded top cap 24 is threaded over the top end of the outer wall and threaded onto exterior threads 28 of the outer wall, wherein the top cap engages and applies a downward force on the upper surface of the top packing member, of the stack of packing members. In some embodiments, a top ring 26 may be disposed between the top cap and the top packing member. The downward force on the top packing member, in turn, compresses each of the packing members, between the top cap and the lower supporting surface, thereby causing the packing members to bulge and form a tight seal between the packing members and each of the polished rod and the outer wall.

As the polished rod oscillates up and down through the stuffing box, while the well is in operation, contact between the packing members and the moving rod tends to cause the packing members to wear out, thereby reducing the compression forces in the packing members, and losing the seal between the packing members and each of the polished rod and the outer wall. A user may reestablish the seal by threading the top cap further onto the outer wall, thereby further compressing the packing members. This procedure, of threading the top cap further onto the outer wall to further compress the packing members and reestablish the seal may be repeated multiple times until the packing members are so worn that the seal can no longer be reestablished. At this point, it is necessary for the packing members to be replaced.

It is not uncommon for a wellhead in continuous operation to be frequently serviced, wherein the top cap is threaded further onto the outer wall to reestablish the seal, approximately once or multiple times per week. In many cases, this may continue for several months until the packing material is so worn that it is ultimately replaced, and the process repeats again. The frequent servicing of wellheads, for tightening the top cap of the stuffing box, is very costly for labor. In addition, the repetitive loss of the seal, as the packing members 16 wear out between servicing, results in leakage of process water and/or crude oil from the wellhead, also at great expense for loss of product and/or clean-up There have been no products available as original equipment or as an aftermarket to address this problem.

An apparatus to provide a leak proof stuffing box, minimizing the man hours required for the labor intensive process that the current stuffing boxes require to function adequately. There have been no products available as original equipment or as an aftermarket to address this problem either.

There exists a need for an apparatus such as the Spring-Loaded Self-Adjusting Stuffing Box, which is an improved wellhead stuffing box cap for preventing leaks and minimizing the need for frequent servicing, that is not being met by any known or disclosed device or system of present.

SUMMARY OF THE INVENTION

The main purpose of the Spring-Loaded Self-Adjusting Stuffing Box is to provide users with an improved stuffing box cap that adjusts for packing and prevent leakage when operating wells.

Embodiments of an improved stuffing box cap may comprise a spring, such as a coil spring, coupled between a loading plate and the packing members of a stuffing box, and a housing threaded over the loading plate and the coil spring onto the outer wall of the stuffing box. The loading plate compresses the coil spring, which applies constant pressure on and compresses the packing members, causing the packing members to bulge continuously, as they wear out, thereby maintaining a seal between the packing members and a polish rod while in operation through the life of the packing members. The loading plate may be adjusted to adjust the spring force in the spring. The entire assembly has an aperture there through along its longitudinal axis for receiving the polish rod there through. Some embodiments may comprise a stuffing box having an improved stuffing box cap coupled thereto.

The foregoing and other features and advantages of the present invention will be apparent from the following more detailed description of the particular embodiments of the invention, as illustrated in the accompanying drawings.

Figure 1:
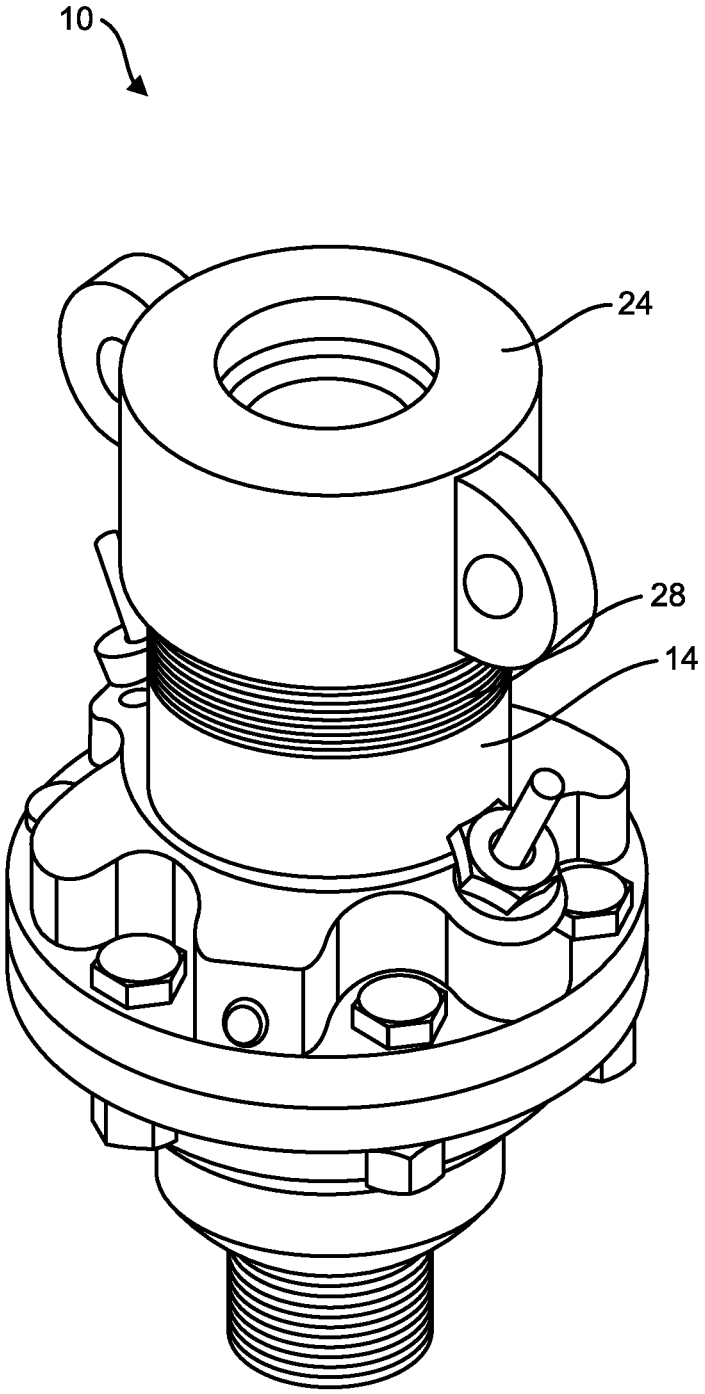
(Prior Art) FIG. 1
FIG. 1 is a perspective view of a conventional prior art wellhead stuffing box.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

As discussed above, embodiments of the present invention relate to wellheads, and particularly to an improved wellhead stuffing box cap for preventing leaks and minimizing the need for frequent servicing. The cap comprises a spring for applying constant pressure on and compressing the packing members in the stuffing box.

Figure 2A:
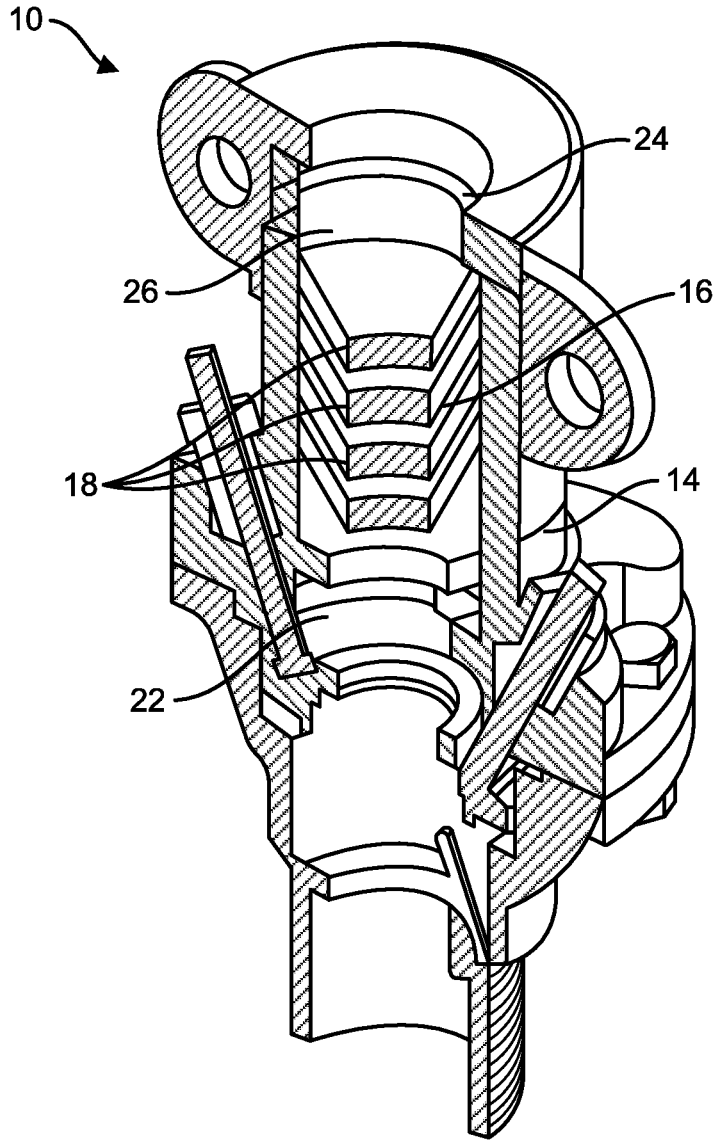
(Prior Art) FIG. 2A
FIG. 2A is a sectional view of a conventional prior art wellhead stuffing box comprising cone-type packing members.
Figure 2B:
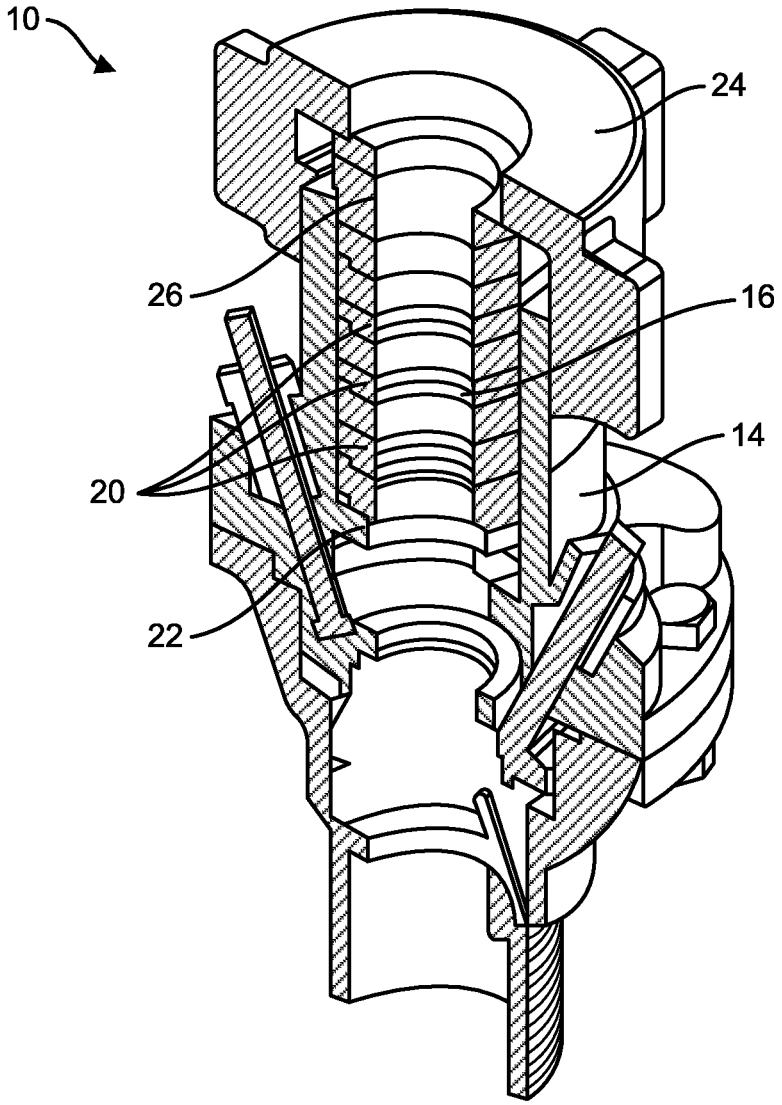
(Prior Art) FIG. 2B
FIG. 2B is a sectional view of a conventional prior art wellhead stuffing box comprising mound- or dome-type packing members.
Figure 3:
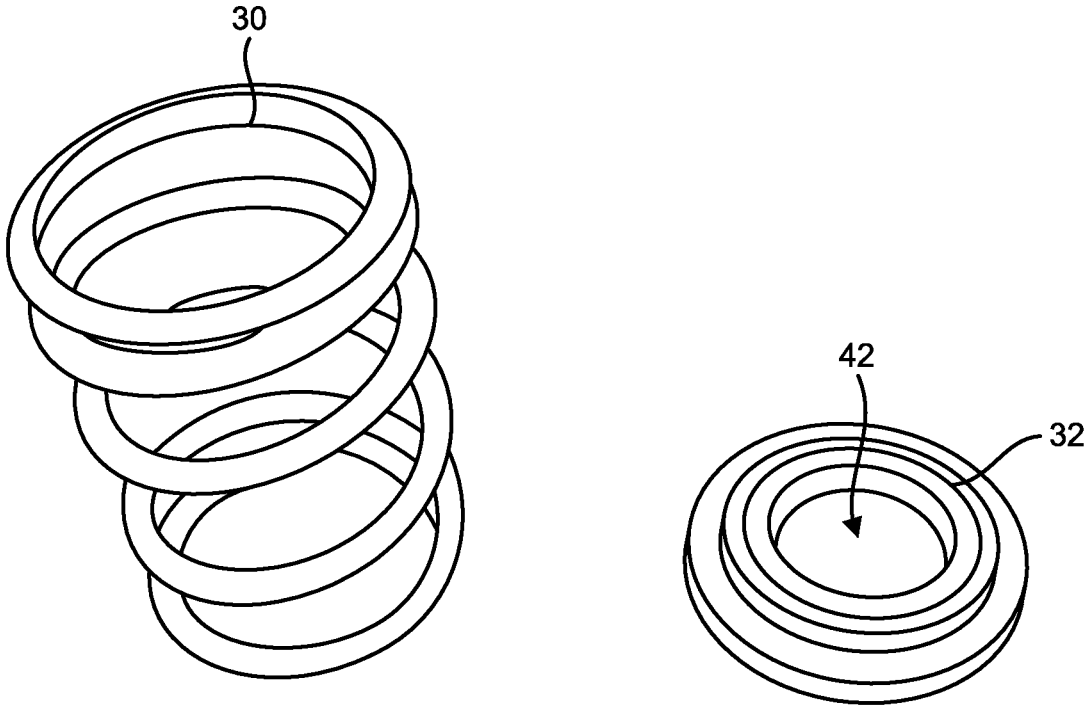
FIG. 3 is a perspective view of a spring and an adaptor plate of an improved wellhead stuffing box cap of the present invention, according to an embodiment.

Referring to the drawings, FIGS. 3-11 illustrate and embodiment of an improved wellhead stuffing box cap 12, of the present invention, comprising an adaptor plate 32, a coil spring 30, a loading plate 34, and a housing 36. A wellhead stuffing box cap 12, of the present invention, is used in place of a conventional threaded top cap 24 of a wellhead stuffing box 10, shown in FIGS. 1, 2A, and 2B.

Figure 4:
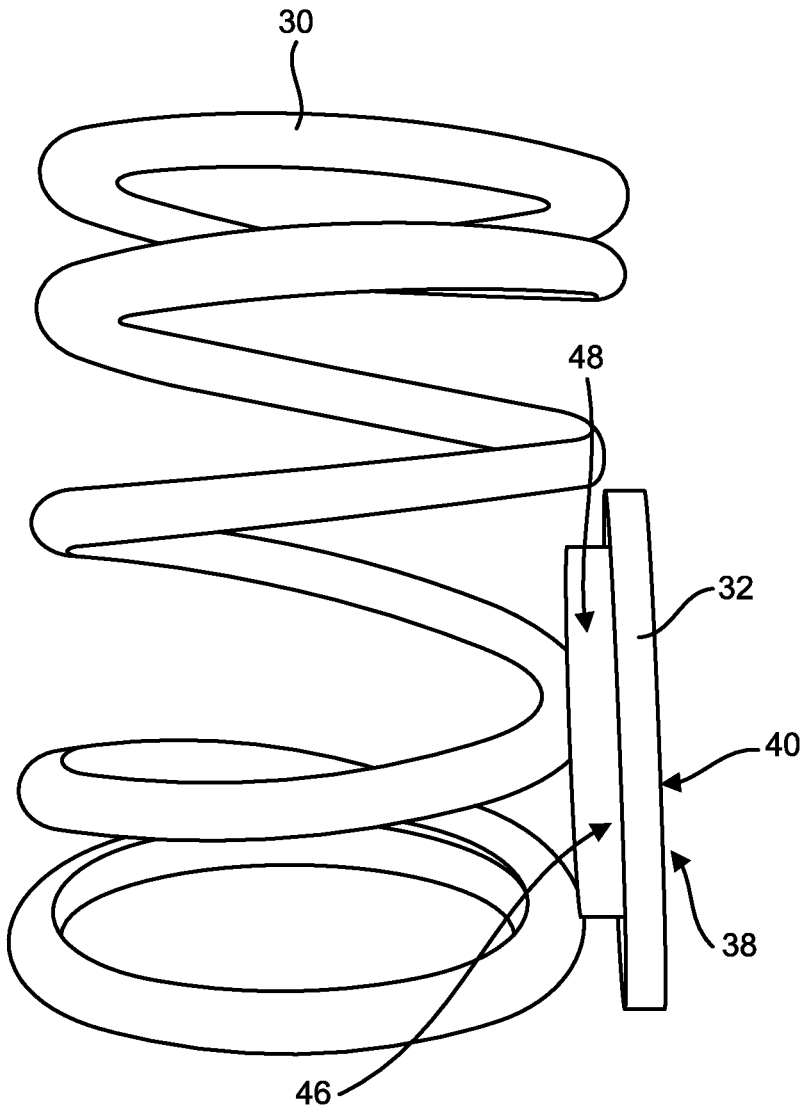
FIG. 4 is a side view of a spring and an adaptor plate of an improved wellhead stuffing box cap, according to the embodiment of FIG. 3.
Figure 5:
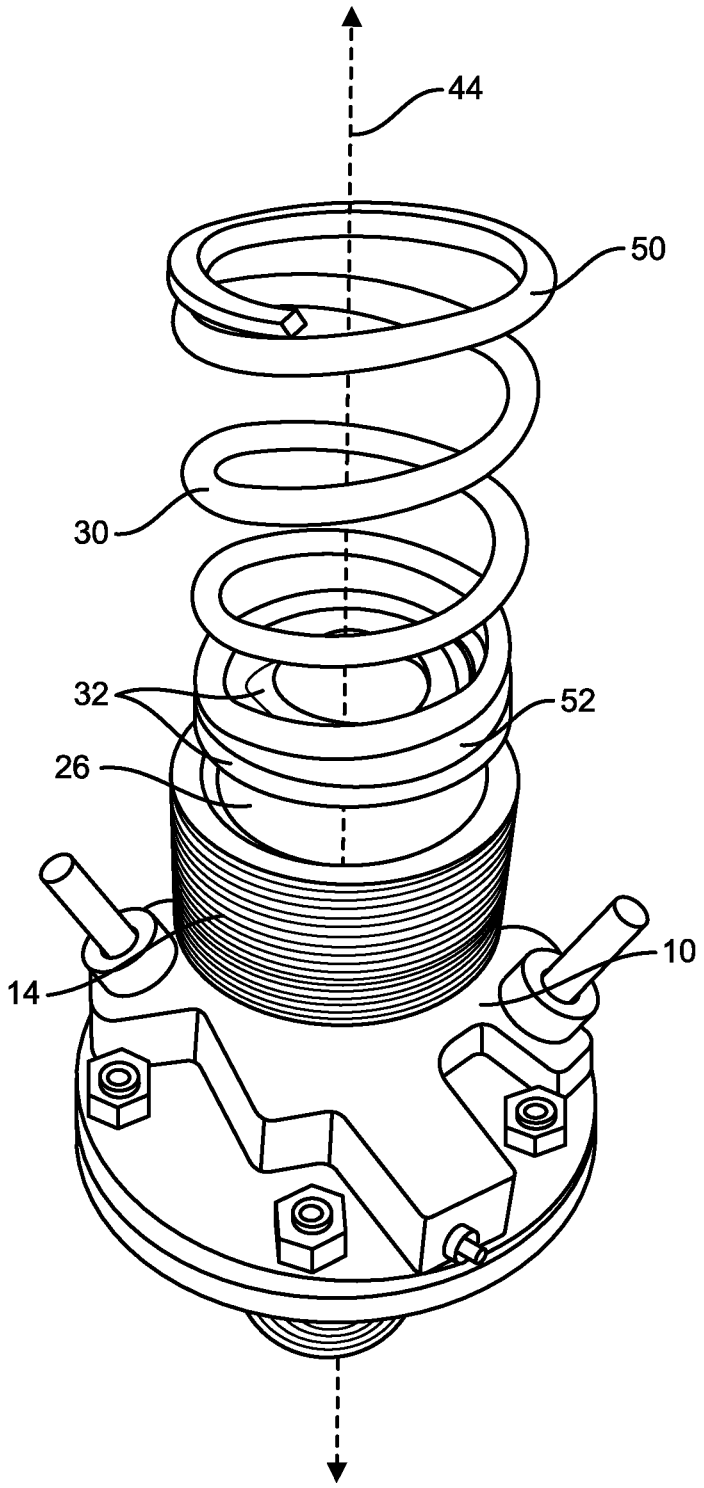
FIG. 5 is a perspective view of an adaptor plate and spring seated on a top ring of a wellhead stuffing box.
Figure 6:
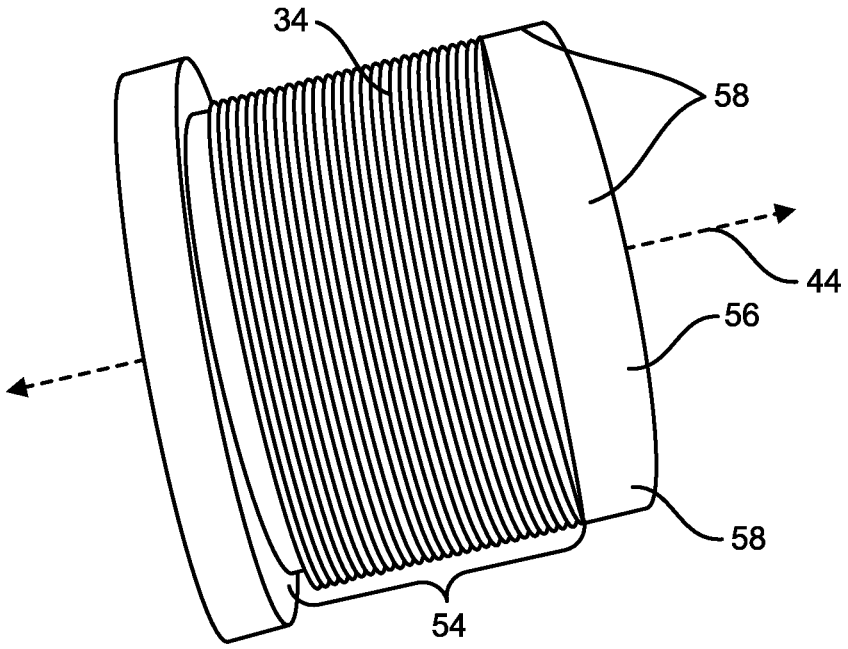
FIG. 6 is a perspective view of a loading plate of an improved wellhead stuffing box cap, according to an embodiment.
Figure 9:
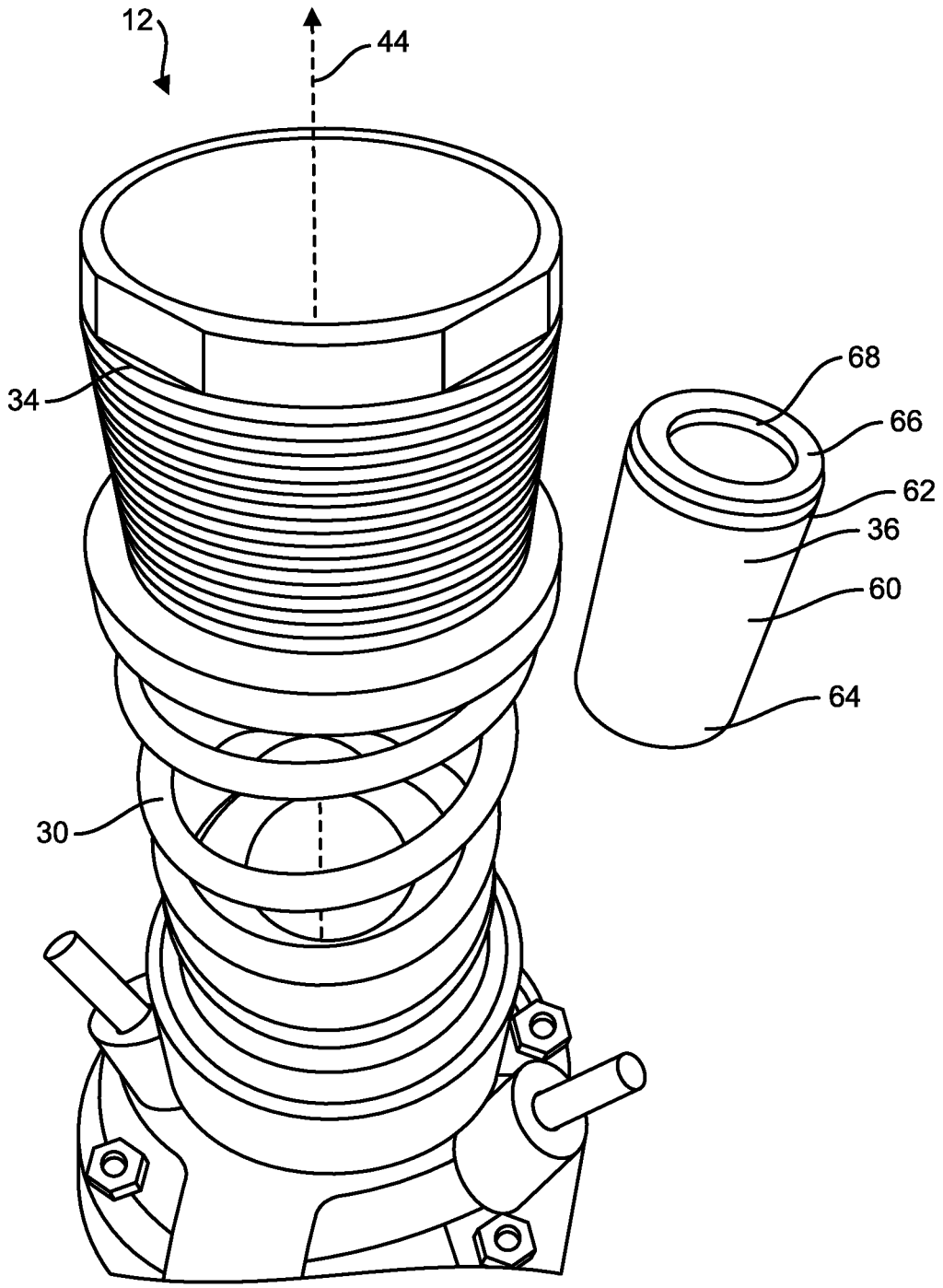
FIG. 9 is a perspective view of an adaptor plate, spring, and loading plate seated on a top ring of a wellhead stuffing box, and a perspective view of a housing removed from the stuffing box assembly, according to an embodiment.
Figure 10:
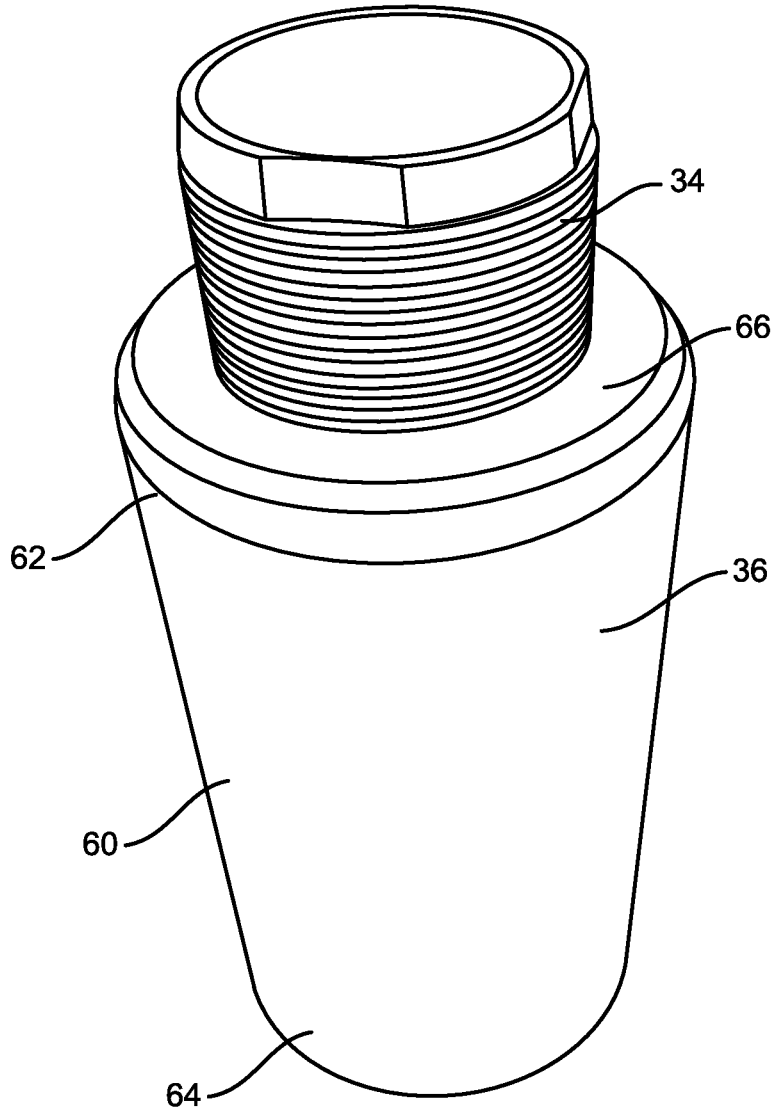
FIG. 10 is a perspective view of a housing threaded over a loading plate of an improved wellhead stuffing box cap, according to an embodiment.

In practice, the conventional threaded top cap 24 of a wellhead stuffing box 10 is removed and replaced with an improved wellhead stuffing box cap 12 of the present invention. An adaptor plate 32, of the present invention, is configured to rest on and engage a top packing member 16 of the stuffing box 10, or for a stuffing box 10 comprising a top ring 26 over the top packing member 16, the adaptor plate 32 is configured to rest on and engage the top ring 26, which, in turn, rests on and engages the top packing member 16. In some embodiments, as shown in FIG. 4, the adaptor plate 32 may comprise a lower recess 38 around the perimeter thereof on a bottom surface thereof 40, to conform with the profile of the upper surface of the top packing member 16 or top ring 26 upon which it rests, accordingly, as shown in FIG. 5. The adaptor plate 32 comprises a central aperture 42 through which a polish rod of the wellhead passes. The lower recess 38 aligns the adaptor plate 32 with the top ring 26 and packing members 16, which are coaxial with the stuffing box 10 along a longitudinal axis 44 thereof, as shown in FIGS. 5 and 9.

A top surface 46 of the adaptor plate 32 may comprise an upper recess 48 around the perimeter thereof, as shown in FIG. 4, for receiving a coil spring 30, wherein a lower end 52 of the coil spring 30 engages and is supported on the adaptor plate 32 and is coaxial therewith. The upper recess 48 aligns the coil spring 30 coaxial with the adaptor plate 32, as shown in FIG. 5. A loading plate 34 engages and is supported by a top end 50 of the coil spring 30, wherein the loading plate 34 is coaxial with the coil spring 30. The loading plate 34 may comprise an exterior-threaded tubular portion 54 extending upward therefrom, and, in some embodiments, a top end portion 56 comprising a plurality of opposed flat surfaces 58. The opposed flat surfaces 58 are configured to be engaged by a wrench, wherein a user may use a wrench to rotate the loading plate 34 about its longitudinal axis 44.

Figure 7:
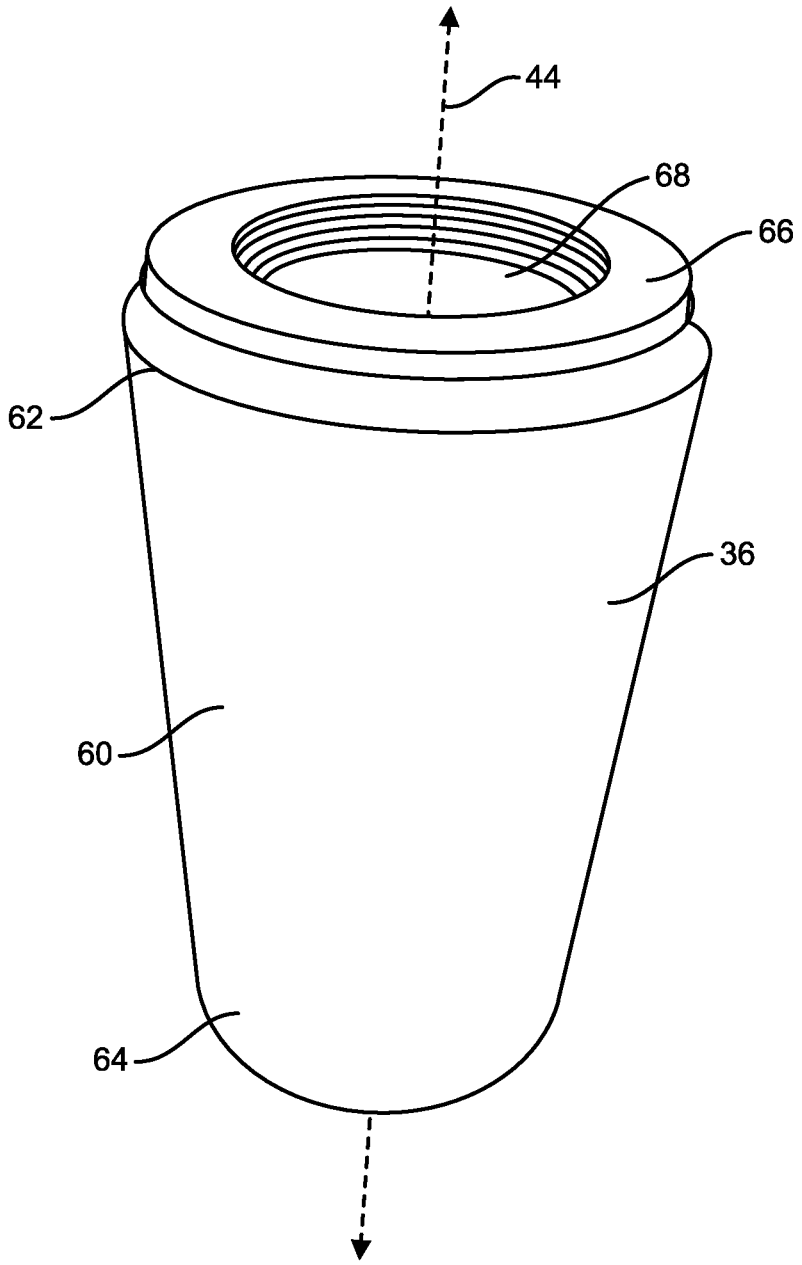
FIG. 7 is a perspective view of a housing of an improved wellhead stuffing box cap, according to an embodiment.
Figure 8:
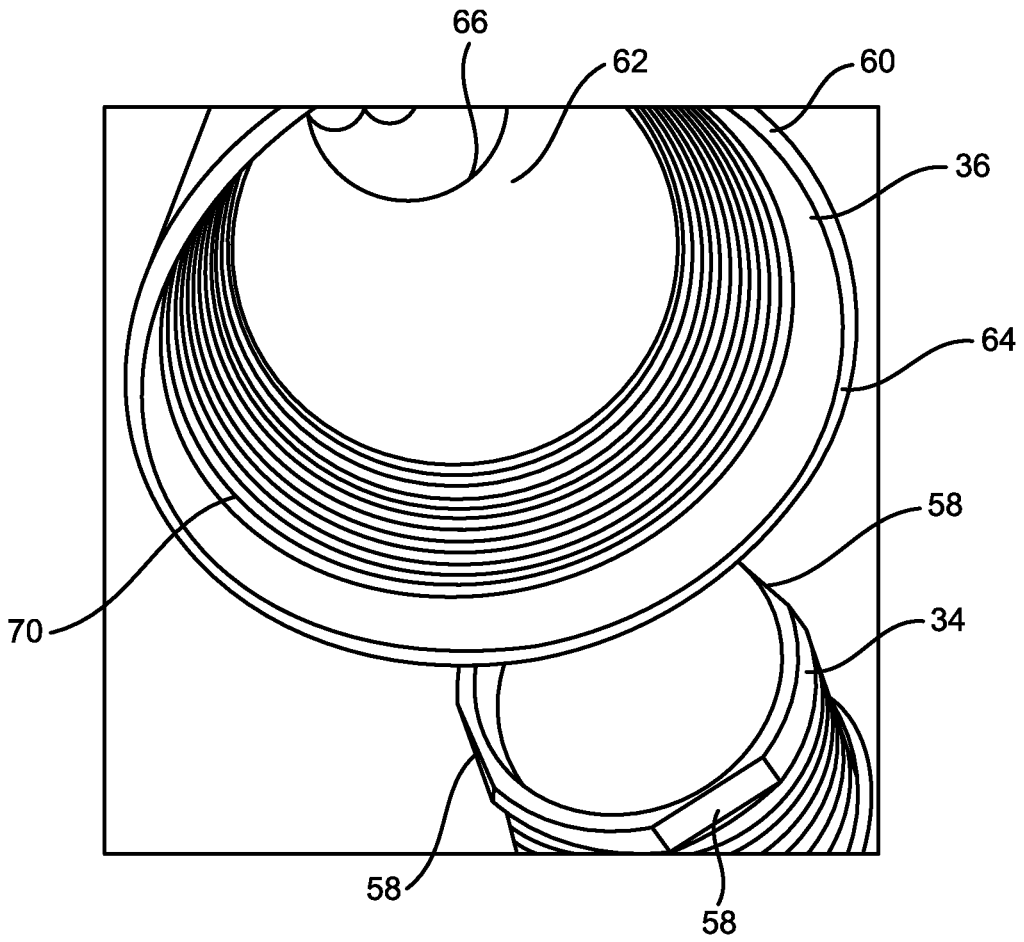
FIG. 8 is a perspective view showing the interiors of a housing and a loading plate of an improved wellhead stuffing box cap, according to an embodiment.
Figure 11:
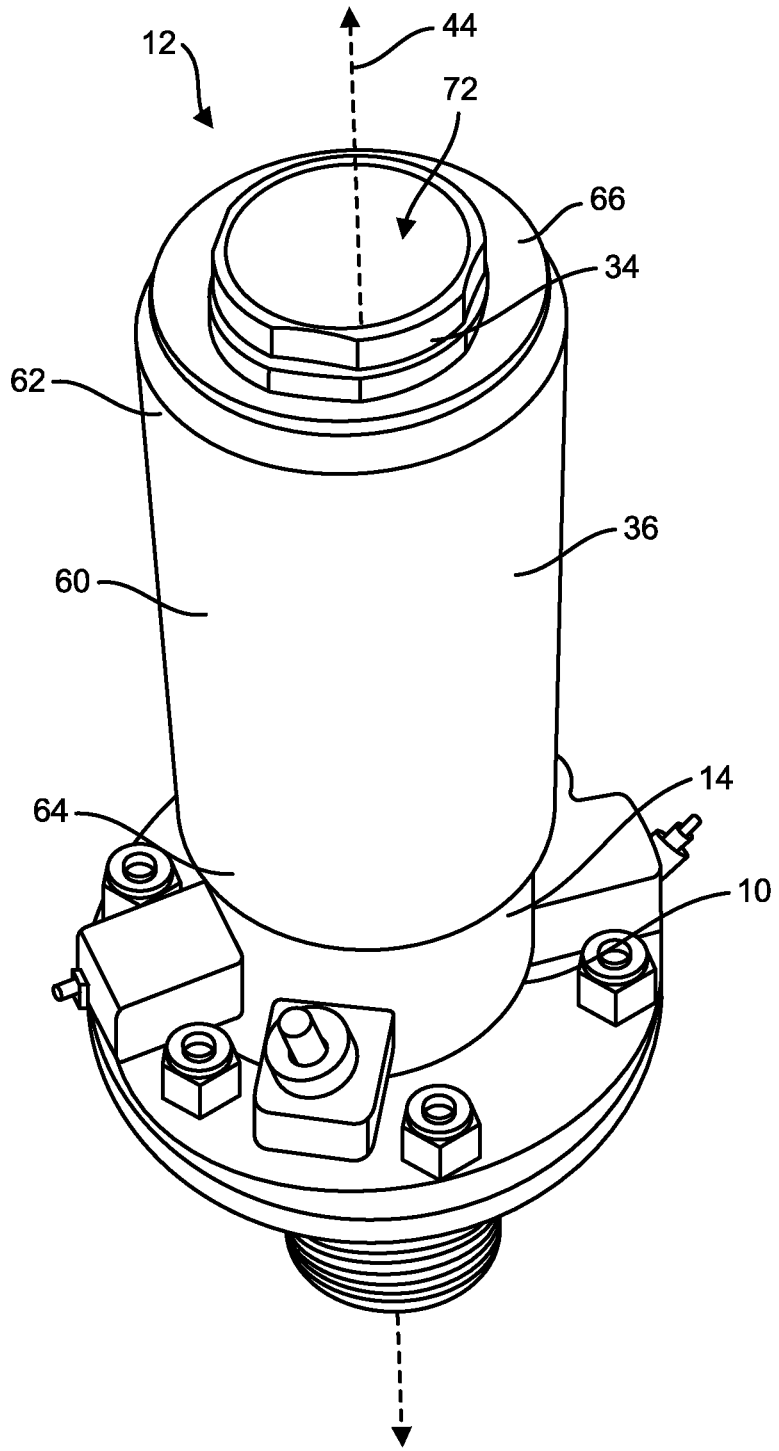
FIG. 11 is a perspective view of a fully-assembled improved wellhead stuffing box cap coupled to a wellhead stuffing box, according to an embodiment.

As shown in FIG. 7, the housing 36 may comprise an elongate tubular body 60 having a top end 62 and opposed bottom end 64. The top end 62 may comprise a top end ring portion 66 having an inner diameter corresponding to the outer diameter of the exterior-threaded tubular portion 54 of the loading plate 34, wherein the top end ring portion 66 has inner threads 68 corresponding to the exterior threads of the exterior-threaded tubular portion 54 of the loading plate 34. The bottom end 64 of the housing 36 may have an inner diameter corresponding to the exterior-threaded portion of the outer wall 14 of the stuffing box 10, wherein the bottom end 64 comprises interior threads 70 corresponding to the exterior threads of the exterior-threaded portion of the outer wall 14. As shown in FIG. 11, the housing 36 is installed over the loading plate 34, the coil spring 30, and the adaptor plate 32 and threaded onto the exterior-threaded portion of the outer wall 14 with the exterior-threaded tubular portion 54 of the loading plate 34 extending upward through and threaded to the top end ring portion 66 of the housing 36, wherein the adaptor plate 32 is free to slide within the housing 36 in response to the force of the spring 30 acting on the adaptor plate 32.

As shown in FIG. 11, an aperture 72 extends through the entire stuffing box 10 and stuffing box cap 12 assembly, along the central longitudinal axis 44 thereof, for receiving the polish rod therethrough (not shown), wherein the aperture 72 has a diameter corresponding to the diameter of the polish rod. In operation, the polish rod oscillates upward and downward through the aperture 72 while the well is in use.

When fully assembled, the coil spring 30 is compressed between the loading plate 34 and the adaptor plate 32, and the packing members 16 are compressed between the adaptor plate 32 and the lower supporting surface 22 of the stuffing box 10, wherein the packing members 16 bulge to form a seal between the polish rod and the outer wall 14 of the stuffing box 10. The downward force of the loading plate 34 on the coil spring 30 causes the coil spring 30 to exert a downward force on the adaptor plate 32, which, in turn, exerts a downward force on the top ring 26 or top packing member 16, accordingly, which compresses the packing members 16 between the adaptor plate 32 and the lower supporting surface 22 of the stuffing box 10. Threading the housing 36 further onto the outer wall 14 of the stuffing box 10 further compresses the coil spring 30 and the packing members 16, causing the packing members 16 to bulge further and tighten the seal between the polish rod and the outer wall 14 of the stuffing box 10. Unthreading the housing 36 decompresses the coil spring 30 and the packing members 16, causing the packing members 16 to bulge less and loosen the seal. With the housing 36 threaded, whether fully threaded or not, onto the outer wall 14 of the stuffing box 10, the loading plate 34 may be rotated by a user, relative to the housing 36, wherein the loading plate 34 may be threaded more or less through the top end ring portion 66 of the housing 36. This may be done oy the user applying a wrench to any of the opposed flat surfaces 58 of the top end portion 66 of the loading plate 34 to rotate the loading plate 34 relative to the housing 36. Rotating the loading plate 34 in a first direction moves the loading plate 34 downward relative to the housing 36, further compressing the coil spring 30 and the packing members 16. Rotating the loading plate 34 in the opposite direction moves the loading plate 34 upward relative to the housing 36, causing the coil spring 30 and the packing members 16 to decompress.

With the well in operation, the housing 36 may be threaded onto the outer wall 14 of the stuffing box 10, the loading plate 34 being adjusted to cause a downward force through the coil spring 30 to compress the packing members 16 enough to form a seal between the polish rod and the outer wall 14 of the stuffing box 10. As the polish rod oscillates up and down through the stuffing box 10, contact of the polish rod and the packing members 16 tends to cause the packing members 16 to wear out, thereby breaking the seal between the polish rod and the packing members 16. However, the coil spring 30 exerts a continuous downward force on the packing members 16, making up for any wear of the packing members 16, and tending to bulge the packing members 16 sufficiently to maintain a constant seal between the packing members 16 and the polish rod. As the packing members 16 wear out, the constant force from the coil spring 30 makes up the difference, moving the adaptor plate 32 slightly and continuously downward in continuous adjustment to maintain sufficient bulge in the packing members 16 to maintain the seal. This eliminates the need for labor to repeatedly tighten a top cap 24 to reestablish a broken seal as the packing members 16 wear out. Eventually, the packing members 16 will wear out sufficiently to require replacement. However, the need for repetitive tightening throughout the life of the packing members 16 is eliminated. This results in significant cost savings for labor to repeatedly service wellheads as well as significant savings by eliminating loss of product and/or clean-up due to leakage of process water and/or crude oil.

It is contemplated that, in some embodiments, a coil spring 30 may develop memory over time, rendering the coil spring 30 less effective by reducing the spring force in the coil spring 30. This may be overcome by a user simply adjusting the loading plate 34 downward to increase the spring force in the coil spring 30 sufficiently to compensate, still without the need for repetitive adjustments to maintain the seal.

While an improved wellhead stuffing box cap 12, of the present invention, comprises a coil spring 30, as described above and shown in the drawings, this is not intended to be limiting. It is contemplated that a stuffing box cap 12 may comprise other types of spring 30, such as a disk spring, a gas cylinder spring, a gas chamber or gas bag spring, or the like, other than a gas cylinder spring, or any other suitable spring 30 or combination thereof, known now or in the future, for performing the function of applying a continuous force on the packing members 16 of a stuffing box 10 to bulge the packing members 16 sufficiently to maintain a seal between the packing members 16 and a polish rod through the life of the packing members 16. In a like manner, while the adaptor plate 32 and the loading plate 34 are shown and described as continuous ring members, it is contemplated that, in some embodiments, other suitable means may be employed to adjust the spring force in the spring 30 without departing from the spirit of the invention disclosed herein, such as by use of bolts in place of continuous rings, for example, wherein a primary function of the invention is to apply a continuous force through a spring 30 or equivalent to continuously bulge the packing members 16 of a stuffing box, as the packing members 16 wear out during use, through the life of the packing members 16, to maintain the seal between the packing members 16 and the polish rod, thereby eliminating the need to repetitively tighten a top cap 24 of a stuffing box 10 to reestablish the seal as the packing members 16 wear out.

Some embodiments of the present invention may comprise a stuffing box 10 having an improved stuffing box cap 12, as described above, coupled thereto. Some embodiments of a wellhead stuffing box cap 12 may not include a loading plate 34. In such embodiments, the spring 30 may be compressed by engagement directly with the housing 36. In other embodiments, the housing 36 and the loading plate 34 may be a single component of unitary construction. Some embodiments of a wellhead stuffing box cap 12 may not include an adaptor plate 32. In such embodiments the spring 30 may engage either the top ring 26 or the top packing member 16 directly.

The components defining any wellhead stuffing box cap 12 may be formed of any of many different types of materials or combinations thereof that can readily be formed into shaped objects provided that the components selected are consistent with the intended operation of a wellhead stuffing box cap 12. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide;

Polycarbonate, Polyethylene, Polysulfone, and/or the like), thermosets (such as Epoxy, Phenolic Resin, Polyimide, Polyurethane, Silicone, and/or the like), any combination thereof; and/or other like materials; composites and/or other like materials; metals, such as copper, zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any wellhead stuffing box cap 12 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, sewing, any combination thereof; and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The present disclosed Spring-Loaded Self-Adjusting Stuffing Box, also known as "The Mechanical Adjusting Stuffing Box Cap", offers a modern accessory that not only prevents the stuffing box from leaking but also eliminates the need for individuals to constantly and manually adjust the packing cap; thus, saving time and energy. Comprised of quality materials, the Mechanical Adjusting Stuffing Box Cap introduces a novel cap that easily screws on top of a wellhead and utilizes an advanced pumping unit. It relies on constant spring pressure to unload until the outer housing is completely screwed on. As a result, the adjusting collar is properly modified to guarantee that the spring pressure that is applied to the packing, efficiently seals the polish rod liner to the well. This in return significantly minimizes the time spent by lease operators that would otherwise have to manually adjust the packing cap. Furthermore, unlike other stuffing caps, the Mechanical Adjusting Stuffing Box Cap accounts for the seating and wear of the packing and sets the pressure from the very beginning of the operation to prevent leakage and eliminate the need for readjustments during utilization. This innovative, top-quality product enhances the functionality of an average cap and may prove to be essential in the electronics fuel/energy industry.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. An improved wellhead stuffing box device comprising:

an elongate stuffing box configured to attach to a wellhead stuffing box having an upper end thereof, the elongate stuffing box comprising:

a spring configured to be received in the elongate stuffing box and having a corresponding first end and second end;

an adapter plate configured to interface between an existing packing in the elongate stuffing box and the first end of the spring;

a loading plate configured to interface with the second end of the spring, wherein the loading plate is provided with an exterior-threaded tubular portion extending upwardly from the second end of the spring, wherein a top end portion is provided on the loading plate extending upwardly from the exterior-threaded tubular portion and wherein a plurality of opposed flat surfaces is provided about the top end portion of the loading plate;

an elongate tubular body provided with inner threads on an upper portion thereof, wherein the exterior-threaded tubular portion of the loading plate is configured to threadingly engage the inner threads of the upper portion of the elongate tubular body, wherein interior threads are provided on a lower portion of the elongate tubular body, an outer wall provided about the upper end of the wellhead stuffing box, an exterior-threaded portion is provided on the outer wall of the wellhead stuffing box and is configured to threadingly engage the interior threads of the lower portion of the elongate tubular body;

wherein the plurality of opposed flat surfaces at the top end portion of the loading plate extend through and upwardly from the upper portion of the elongate tubular body; and wherein the adapter plate is free to move longitudinally within the elongate stuffing box on a concentric axis parallel to a polish rod therein.

2. The wellhead stuffing box device of claim 1, wherein the plurality of opposed flat surfaces of the loading plate is configured to be engaged by a wrench for twisting thereof.

3. The wellhead stuffing box device of claim 1, wherein the loading plate is configured to threadingly engage the inner threads of the upper portion of the elongate tubular body and compresses or decompresses an adjacent packing via the spring.

4. The wellhead stuffing box device of claim 1, wherein the loading plate supports a packing between the elongate stuffing box and the polish rod therein.

5. The wellhead stuffing box device of claim 1, wherein the spring is selected from the group consisting of a coil spring, a disk spring, a gas cylinder spring, a gas chamber and/or a gas bag spring.

6. The wellhead stuffing box device of claim 1, wherein the spring is configured to apply a continuous force on a plurality of packing members on both a first end and a second end thereof.

7. The wellhead stuffing box device of claim 1, further comprising a plurality of packing members configured to bulge in response to a force of the spring to form a seal between the plurality of packing members and the polish rod.

8. The wellhead stuffing box device of claim 1, further comprising a top ring for the adaptor plate configured to receive the spring and to engage a top packing member of the elongate stuffing box.

9. The wellhead stuffing box device of claim 1, further comprising a central aperture, through which the polish rod passes.

* * * * *